US005750319A

United States Patent [19]

Horsten et al.

[11] Patent Number: 5,750,319

[45] Date of Patent: May 12, 1998

[54] SUBSTANTIALLY NON-PHOTOSENSITIVE THERMOGRAPHIC RECORDING MATERIAL WITH IMPROVED STABILITY AND IMAGE-TONE

[75] Inventors: Bartholomeus Horsten, Rumst; Johan Loccufier, Zwijnaarde; Geert Defieuw, Bonheiden; Luc Leenders, Herentals, all of Belgium

[73] Assignee: Agfa-Gevaert, Mortsel, Belgium

[21] Appl. No.: 856,098

[22] Filed: May 14, 1997

[30] Foreign Application Priority Data

May 21, 1996 [EP] European Pat. Off. ..... 96201375

[51] Int. Cl.[6] ..... G03C 1/49; G03C 1/494; G03C 1/34

[52] U.S. Cl. ..... 430/346; 430/611; 430/614; 430/616; 430/618; 430/620; 430/964; 430/965; 503/227

[58] Field of Search ..... 430/616, 618, 430/619, 620, 965, 964, 233, 611, 614, 346; 503/227

[56] References Cited

U.S. PATENT DOCUMENTS

| | | | |
|---|---|---|---|
| 3,080,254 | 3/1963 | Grant | 430/964 |
| 4,170,480 | 10/1979 | Ikenove et al. | 430/619 |
| 5,196,301 | 3/1993 | Simpson et al. | 430/619 |

*Primary Examiner*—Richard L. Schilling
*Attorney, Agent, or Firm*—Baker & Botts, L.L.P.

[57] ABSTRACT

A substantially non-photosensitive recording material comprising a thermosensitive element comprising a substantially light-insensitive organic silver salt, an organic reducing agent therefor in thermal working relationship therewith and a binder, on a support, characterized in that the thermosensitive element further comprises in reactive association with the light-insensitive organic silver salt and the organic reducing agent a 1,2,4-triazole compound with at least one of the nitrogen atoms having a hydrogen atom and none of the carbon atoms being part of a thione-group, said compound not being annulated with an aromatic ring system; and a thermal image recording process therefor.

6 Claims, No Drawings

SUBSTANTIALLY NON-PHOTOSENSITIVE THERMOGRAPHIC RECORDING MATERIAL WITH IMPROVED STABILITY AND IMAGE-TONE

DESCRIPTION

1. Field of the invention

The present invention relates to a substantially non-photosensitive thermographic material suitable for thermal development. In particular, it concerns improvements in stabilization thereof.

2. Background of the invention

Thermal imaging or thermography is a recording process wherein images are generated by the use of imagewise modulated thermal energy.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Direct thermal thermography is concerned with materials which are substantially not photosensitive, but are sensitive to heat or thermosensitive. Imagewise applied heat is sufficient to bring about a visible change in a thermosensitive imaging material.

According to U.S. Pat. No. 3,080,254 a typical heat-sensitive (thermographic) copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process causes a visible change to occur in the heat-sensitive layer. Thermosensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

DOS 2127 169 discloses a light- and heat-sensitive recording material, comprising a support and at least one light- and/or heat-sensitive layer thereon, which contains a binder and an oxidation-reduction image-forming combination comprising (i) a heavy metal salt oxidizing agent, (ii) a reducing agent and (iii) a stabilizer precursor together with a photosensitive silver halide or another photosensitive metal salt, a sensitizing dye and/or an activator-toning agent, characterized in that it contains as stabilizer precursor an azole thioether or a blocked azole thione. According to "Organic Chemistry", Volume 2 by I. L. Finar, Longman, London (1977) pages 606 to 607: azoles are unsaturated heterocyclic five-membered rings with at least one nitrogen atom.

In the May 1978 issue of Research Disclosure No. 16979 paragraph 2 it is disclosed that certain mercaptotriazoles, particularly 3-amino-4-benzyl-5-mercapto-1,2,4-triazole, act as stabilizers for silver halide for reducing post-process printup in a photothermo-graphic material for producing a dye enhanced silver image.

Stabilization to light of direct thermal recording materials utilizing oxidation-reduction image-forming processes based on substantially light-insensitive organic silver salts and reducing agents therefor is important for images for medical applications requiring long term stability for legal reasons, which may be viewed using a viewbox. Furthermore improved stabilization to light must not be achieved at the expense of other image characteristics in particular colour neutrality of both the background and the maximum density. The colour neutrality of black monochrome images can be quantified by spectrophotometric measurements according to ASTM Norm E179-90 in a R(45/0) geometry with evaluation according to ASTM Norm E308-90 to produce the CIELAB a* and b* coordinates and the colour neutrality of the maximum density can be quantified using the numerical colour value (NCV). The NCV value is defined as:

$$NCV = \frac{D_1 \times D_2}{(D_3)^2}$$

where $D_1$, $D_2$ and $D_3$ are lowest, next highest and highest respectively of the optical densities measured with a MacBeth™ TR924 densitometer through blue, green and red filters. The larger the NCV value the better the colour neutrality, with maximal colour neutrality corresponding to a NCV-value of 1.

OBJECTS OF THE INVENTION

It is therefore an object of the invention to provide a means of stabilizing the image of direct thermal imaging materials to light.

It is a further object of the invention to obtain a black monochrome image with a background with a good colour neutrality as shown by CIELAB a* and b* coefficients.

It is a further object of the invention to obtain a black monochrome image with a maximum density with a good colour neutrality as shown by the NCV value.

It is a still further object of the invention to provide a process utilizing a substantially non-photosensitive recording material with improved light stabilization to obtain a direct thermal image.

It is another object of the invention to provide a process utilizing a substantially non-photosensitive recording material with improved light stabilization to obtain a black monochrome direct thermal image with a background with a good colour neutrality as shown by its CIELAB a* and b* coefficient and a maximum optical density with a good colour neutrality as shown by its NCV value.

Further objects and advantages of the invention will become apparent from the description hereinafter.

SUMMARY OF THE INVENTION

The above mentioned objects are realised by a substantially non-photosensitive recording material comprising a thermosensitive element comprising a substantially light-insensitive organic silver salt, an organic reducing agent therefor in thermal working relationship therewith, a 1,2,4-triazole compound with at least one of the nitrogen atoms having a hydrogen atom and none of the carbon atoms being part of a thione-group, the compound not being annulated with an aromatic ring system, in reactive association with the substantially light-insensitive organic silver salt and the organic reducing agent and a binder, on a support.

The above objects are also realized by a thermal image recording process comprising the steps of: (i) providing a substantially non-photosensitive recording material, as described above; (ii) bringing an outermost layer of the recording material into proximity with a heat source; (iii) applying heat from a heat source image-wise to the recording material while maintaining proximity to the heat source to produce an image; and (iv) separating the recording material from the heat source.

Preferred embodiments of the invention are disclosed in the dependent claims.

DETAILED DESCRIPTION OF THE INVENTION

According to a preferred embodiment a thermal image forming process, according to the present invention, is realized, wherein the heat source is a thermal head.

According to a particularly preferred embodiment a thermal image forming process, according to the present invention, is realized, wherein the heat source is a thin film thermal head.

According to particularly preferred embodiment, a thermal image recording process, according to the present invention, is realized, wherein the image is a black monochrome image with a background after 3 days exposure of the image-wise heated substantially non-photosensitive recording material on top of a 5 mm thick white PVC window of a specially constructed light-box fitted with Planilux™ TLD 36W/54 fluorescent lamps placed such that the tops of the fluorescent lamps are 35 mm below the undermost side of the image-wise heated substantially non-photosensitive recording material at a temperature of 30° C. and a relative humidity of 85%, which has CIELAB a* and b* coordinates as calculated according to ASTM Norm E308-90 from spectrophotometric measurements carried out according to ASTM Norm E179-90 in a R(45/0) geometry in the ranges of 1.5 to +0.4 for the CIELAB a* coordinate and of −5.0 to +4.7 for the CIELAB b* coordinate.

1,2,4-Triazole Compound

According to the present invention the thermosensitive element comprises a 1,2,4-triazole compound with at least one of the nitrogen atoms having a hydrogen atom and none of the carbon atoms being part of a thione-group, the compound not being annulated with an aromatic ring system.

According to a preferred embodiment of the present invention the 1,2,4-triazole compound is substituted at a carbon atom with an alkyl, alkaryl or aryl thioether group. These substituents may themselves also be substituted.

Preferred 1,2,4-triazole compounds with superior stabilizing and image-tone improving properties without an annulated aromatic ring system, according to the present invention, are:

S01:

3-[(4-n-pentadecylbenzoyl)methylthio]-1,2,4-triazole

S02:

5-n-hexylthio-1,2,4-triazole

Thermosensitive Element

The thermosensitive element, according to the present invention, comprises a substantially light-insensitive organic silver salt and an organic reducing agent therefor in thermal working relationship therewith in reactive association with a 1,2,4-triazole compound with at least one of the nitrogen atoms having a hydrogen atom and none of the carbon atoms being part of a thione-group, the ring not being annulated with an aromatic ring system. The element may comprise a layer system in which the ingredients may be dispersed in different layers, with the proviso that all three ingredients are in reactive association with one another i.e. during the thermal development process the reducing agent and the 1,2,4-triazole compound must be present in such a way that they are able to diffuse to the substantially light-insensitive organic silver salt particles so that reduction of the organic silver salt to silver giving the desired image-tone can take place. Furthermore the 1,2,4-triazole compound must be present in such a way that the thermosensitive element can be stabilized against the influence of light.

Organic Silver Salts

Preferred organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Reducing Agents

Suitable organic reducing agents for the reduction of said substantially light-insensitive organic silver salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among the catechol-type reducing agents, i.e. reducing agents containing at least one benzene nucleus with two hydroxy groups (-OH) in ortho-position, the following are preferred: catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, described in EP-A 692 733, are benzene compounds in which the benzene nucleus is substituted by no more than two hydroxy groups which are present in 3,4-position on said nucleus and have in the 1-position of said nucleus a substituent linked to said nucleus by means of a carbonyl group.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, such as described in U.S. Pat. No. 4,001,026; bisphenols, such as described in U.S. Pat. No. 3,547,648; sulfonamidophenols, such as described in Research Disclosure, February 1979, item 17842, in U.S. Pat. Nos. 4,360,581 and 4,782,004, and in EP-A 423 891; or organic reducing metal salts, such as stannous stearate described in U.S. Pat. Nos. 3,460,946 and 3,547,648. The auxiliary reducing agents may be present in the imaging layer or in a polymeric binder layer in thermal working relationship therewith.

Polycarboxylic Acids and Anhydrides Thereof

According to the substantially non-photosensitive recording material of the present invention the thermosensitive element may comprise in addition at least one polycarboxylic acid and/or anhydride thereof in a molar percentage of at least 20 with respect to all said organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Particularly suitable are saturated aliphatic dicarboxylic acids containing at least 4 carbon atoms, e.g. adipic acid, pimelic acid etc. Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Film-forming Binders of the Thermosensitive Element

The film-forming binder of the thermosensitive element containing the substantially light-insensitive organic silver salt may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The layer containing the organic silver salt is commonly coated onto a support in sheet- or web-form from an organic solvent containing the binder dissolved therein, but may be applied from an aqueous medium as a latex, i.e. as an aqueous polymer dispersion. For use as a latex the dispersible polymer has preferably some hydrophilic functionality. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Binder to Organic Silver Salt Ratio

The binder to organic silver salt weight ratio is preferably in the range of 0.2 to 6, and the thickness of the recording layer is preferably in the range of 5 to 50 μm.

Thermal Solvent

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the recording layer contains preferably in admixture with said organic silver salts and reducing agents a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type are described in GB-P 1,439,478 and U.S. Pat. No. 3,951,660, for example 3,4-dihydro-2,4-dioxo-1,3,2H-benzoxazine.

Other Additives

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONEM™ Öl A (from BAYER AG, GERMANY), ultraviolet light absorbing compounds, white light reflecting and/or ultraviolet radiation reflecting pigments and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the substantially non-photosensitive recording material and said paper base substrate.

The support may be in sheet, ribbon or web form and subbed if need be to improve the adherence to the thereon coated thermosensitive recording layer. The support may be made of an opacified resin composition as described in EP's 194 106 and 234 563 and U.S. Pat. Nos. 3,944,699, 4,187,113, 4,780,402 and 5,059,579. Should a transparent base be used, said base may be colourless or coloured, e.g. having a blue colour.

One or more backing layers may be provided to control physical properties such as curl and static.

Outermost Layer

The outermost layer of the substantially non-photosensitive recording material may in different embodiments of the present invention be the outermost layer of the thermosensitive element, a protective layer applied to the thermosensitive element or a layer on the opposite side of the support to the thermosensitive element.

Protective Layer

According to a preferred embodiment of the substantially non-photosensitive recording material, according to the present invention, the thermosensitive element is coated with a protective layer to avoid local deformation of the thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

A protective layer according to the present invention may further comprise a thermomeltable particle optionally with a lubricant present on top of the protective layer as described in WO 94/11199. The lubricant, which may be a surface active agent, a solid lubricant or a liquid lubricant, may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, glycols and phosphoric acid derivatives. Examples of solid lubricants include various higher alcohols such as stearyl alcohol, fatty acids and phosphoric acid derivatives.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Hydrophilic Binder for Outermost Layer

According to an embodiment of the present invention the outermost layer of the substantially non-photosensitive recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking Agents for Outermost Layer

The outermost layer according to the present invention may be crosslinked. Crosslinking can be achieved by using crosslinking agents such as described in WO 95/12495 for protective layers, e.g. tetraalkoxysilanes, polyisocyanates, zirconates, titanates, melamine resins etc., with tetraalkoxysilanes such as tetramethylorthosilicate and tetraethylorthosilicate being preferred.

Matting Agents for Outermost Layer

The outermost layer of the substantially non-photosensitive recording material according to the present invention may comprise a matting agent. Suitable matting agents are described in WO 94/11198 and include e.g. talc particles and optionally protrude from the outermost layer.

Lubricants for Outermost Layer

Solid or liquid lubricants or combinations thereof such as described above for use in protective layers are also suitable for incorporation in the outermost layer to improve the slip characteristics of the substantially non-photosensitive recording materials according to the present invention.

Antistatic Layer

In a preferred embodiment the substantially non-photosensitive recording material of the present invention an antistatic layer is the outermost layer on the other side of the support to the thermosensitive element.

Coating

The coating of any layer of the substantially non-photosensitive recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Processing Configurations

Thermographic imaging is carried by the image-wise application of heat either in analogue fashion by direct exposure through an image or by reflection from an image or in digital fashion pixel by pixel either by using an infra-red heat souce, for example with a Nd-YAG laser or other infra-red laser, or direct thermal imaging with a thermal head.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300° to 400° C. and the heating time per picture element (pixel) may be 50 ms or less, the pressure contact of the thermal printhead with the substantially non-photosensitive recording material being e.g. 100–500 g/cm$^2$ to ensure a good transfer of heat.

In order to avoid direct contact of the thermal printing heads with a substantially non-photosensitive recording material not provided with an outermost protective layer, the imagewise heating of the substantially non-photosensitive recording material with the thermal printing heads may proceed through a contacting but removable resin sheet or web wherefrom during said heating no transfer of substantially non-photosensitive recording material can take place.

In a particular embodiment of the method according to the present invention the direct thermal image-wise heating of the substantially non-photosensitive recording material proceeds by Joule effect heating in that selectively energized electrical resistors of a thermal head array are used in contact or close proximity with said recording layer. Suitable thermal printing heads are e.g. a Fujitsu Thermal Head (FTP-040 MCS001), a TDK Thermal Head F415 HH7-1089 and a Rohm Thermal Head KE 2008-F3. Activation of the heating elements can be power-modulated or pulse-length modulated at constant power.

When used in thermographic recording operating with thermal printheads said substantially non-photosensitive recording materials will not be suited for reproducing images with fairly large number of grey levels as is required for continuous tone reproduction. EP-A 622 217 discloses a method for making an image using a direct thermal imaging element in which improvements in continuous tone reproduction are obtained by heating the thermal recording element by means of a thermal head having a plurality of heating elements in a specific manner.

Direct thermal imaging can be used for both the production of transparencies and reflection type prints. Application of the present invention is envisaged in the fields of both graphics images requiring high contrast images with a very steep print density applied dot energy dependence and continuous tone images requiring a weaker print density applied dot energy dependence, such as required in the medical diagnostic field. In the hard copy field substantially non-photosensitive recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims. The invention is illustrated hereinafter by way of invention examples and comparative examples. The percentages and ratios given in these examples are by weight unless otherwise indicated. The ingredients used in the invention and comparative examples are:

as organic silver salt: silver behenate represented in the examples by AgBeh;

as binder: polyvinyl butyral (BUTVARM™ B79) represented in the examples by PVB;

as reducing agent: ethyl 3,4-dihydroxybenzoate represented by R1;

as toning agents:

benzo[e][1,3]oxazine-2,4-dione represented by TA1;

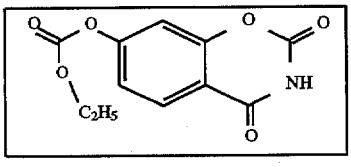

represented by TA2;

as levelling agent: silicone oil (Baysilone™ from Bayer AG) represented by oil;

as stabilizers:

tetrachlorophthalic anhydride represented by S1;

adipic acid represented by S2;

and in the comparative examples the following ingredients to define better the present invention:

C01:

tribromomethyl benzenesulfinate a known antifoggant (JN 50-089018, JN 50-137126 and U.S. Pat. No. 3,874,946) for photothermographic materials

C02:

2-(methylmercapto)-5-methyl-s-triazolo[1,5-a]pyrimidin-7-ol an unsaturated annulated 5-membered heterocyclic ring consisting of nitrogen and carbon atoms without a nitrogen atom with a hydrogen atom

C03:

1-(3,4-dichlorophenyl)-5-mercapto-1,2,3,4-tetrazol an unsaturated 5-membered heterocyclic ring consisting of nitrogen and carbon atoms without a nitrogen with a hydrogen atom substituted with a —SH group

C04:

2-mercapto-5-methyl-1,3,4-oxadiazole an unsaturated 5-membered heterocyclic ring with an oxygen ring atom substituted with a —SH group

C05:

4-phenyl-3-n-tridecyl-5-(3,5-dinitropyridylmercapto)-1,2,4-triazole an unsaturated 5-membered heterocyclic ring consisting of nitrogen and carbon atoms without a nitrogen atom with a hydrogen atom

C06:

2-amino-5-mercapto-1,3,4-thiadiazole an unsaturated 5-membered heterocyclic ring with a sulphur ring atom substituted with a —SH group

INVENTION EXAMPLES 1 and 2 and COMPARATIVE EXAMPLES 1 to 5

A subbed polyethylene terephthalate support having a thickness of 175 μm was doctor blade-coated from a coating composition containing butanone as a solvent and the following ingredients so as to obtain thereon, after drying for 1 hour at 50° C., layers with the compositions given in table 1 for comparative examples 1 to 5 and invention examples 1 and 2.

TABLE 1

| Comparative example number | Additional ingredient number | Additional ingredient quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
|---|---|---|---|---|---|---|---|---|---|---|
| 1 | — | — | 4.98 | 19.91 | 1.020 | 0.272 | 0.139 | 0.044 | 0.159 | 0.424 |
| 2 | C01 | 0.141 | 5.29 | 21.19 | 1.086 | 0.290 | 0.148 | 0.047 | 0.170 | 0.452 |
| 3 | C01 | 0.475 | 5.40 | 21.60 | 1.106 | 0.295 | 0.152 | 0.048 | 0.173 | 0.461 |
| 4 | C02 | 0.068 | 5.19 | 20.75 | 1.062 | 0.284 | 0.145 | 0.046 | 0.166 | 0.442 |
| 5 | C02 | 0.221 | 5.06 | 20.23 | 1.036 | 0.276 | 0.142 | 0.045 | 0.162 | 0.432 |
| Invention example number | | | | | | | | | | |
| 1 | S01 | 0.148 | 5.11 | 20.45 | 1.047 | 0.280 | 0.143 | 0.046 | 0.164 | 0.436 |
| 2 | S01 | 0.490 | 5.11 | 20.43 | 1.046 | 0.279 | 0.144 | 0.046 | 0.163 | 0.436 |

Thermographic Printing

The printer was equipped with a thin film thermal head with a resolution of 300 dpi and was operated with a line time of 19 ms (the line time being the time needed for printing one line). During said line time the print head received constant power. The average printing power, being the total amount of electrical input energy during one line time divided by the line time and by the surface area of the heat-generating resistors was 1.5 mJ/dot being sufficient to obtain maximum optical density in each of said substantially non-photosensitive recording materials. During printing the print head was separated from the imaging layer by a thin intermediate material contacted with a slipping layer of a separable 5 μm thick polyethylene terephthalate ribbon coated successively with a subbing layer, heat-resistant layer and said slipping layer (anti-friction layer) giving the ribbon with a total thickness of 6 μm.

Image Evaluation

The optical maximum and minimum densities of the prints given in table 2 were measured through a visual filter with a Macbeth™ TR924 densitometer in the grey scale step corresponding to data levels of 255 and 0 respectively.

The colour neutrality of the optical density (D) of these images was evaluated by measuring the optical densities through blue, green and red filters using a MacBeth™ TR924 densitometer. The lowest, next highest and highest optical densities were assigned to $D_1$, $D_2$ and $D_3$ respectively and were used to obtain a numerical colour value (NCV) by substituting the corresponding values in the following equation:

$$NCV = \frac{D_1 \times D_2}{(D_3)^2}$$

Maximal colour neutrality corresponds to a NCV value of 1. The larger the NCV value the better the colour neutrality of the image obtained. NCV values were determined at optical densities (D) with a visual filter of 1, 2 and 3 for the fresh materials and for the same materials after being heated at 57° C. in a relative humidity of 34% for 3 days for the materials of comparative examples 1 to 5 and invention examples 1 and 2 and the NCV-values obtained summarized in table 2. The NCV-values in table 2 enable materials with different stabilizing compounds at different concentrations to be compared on the basis of their colour neutrality, the dependence of their colour neutrality upon image optical density and the pre-exposure evolution in colour neutrality.

TABLE 2

| Comparative example number | image characteristics printing with fresh material: $D_{max}$ vis | NCV at D = 1 | NCV at D = 2 | NCV at D = 3 | $D_{min}$ vis | image characteristics printing after 3 days at 57° C. & 34% RH: $D_{max}$ vis | NCV at D = 1 | NCV at D = 2 | NCV at D = 3 | $D_{min}$ vis |
|---|---|---|---|---|---|---|---|---|---|---|
| 1 | 2.83 | 0.92 | 0.97 | 0.95 | 0.07 | 3.67 | 0.75 | 0.78 | 0.80 | 0.07 |
| 2 | 2.37 | 0.87 | 0.77 | | 0.07 | 2.79 | 0.75 | 0.76 | 0.65 | 0.07 |
| 3 | 2.26 | 0.70 | 0.63 | | 0.08 | 2.64 | 0.68 | 0.66 | 0.53 | 0.07 |
| 4 | 2.94 | 0.90 | 0.97 | 0.95 | 0.07 | 3.71 | 0.75 | 0.80 | 0.83 | 0.07 |
| 5 | 2.77 | 0.92 | 0.97 | 0.96 | 0.07 | 3.02 | 0.76 | 0.78 | 0.87 | 0.07 |
| Invention example number | | | | | | | | | | |
| 1 | 2.41 | 0.95 | 0.96 | | 0.07 | 3.37 | 0.74 | 0.89 | 0.73 | 0.08 |
| 2 | 1.77 | 0.96 | | 0.07 | | 2.86 | 0.84 | 0.85 | 0.80 | 0.07 |

It is evident from table 2 that with the exception of the material of comparative examples 2 and 3 with the stabilizing compound C01, all fresh materials of comparative examples 1 to 5 and invention examples 1 and 2 formed images with excellent colour neutralities i.e. NCV-values above 0.90 and that there was also no significant difference in the NCV-values after thermal treatment for 3 days at 57° C. and 34% relative humidity.

materials of comparative examples 1 to 5 and invention examples 1 and 2 thermally pretreated for 3 days at 57° C. and 34% relative humidity are summarized in table 3.

TABLE 3

| Comparative example number | $D_{min}$* pre-exposure | Colour neutrality of background: After 3 days exposure on lightbox at 30° C. & 85% RH | | | | After 6 days exposure on lightbox at 30° C. & 85% RH | | |
|---|---|---|---|---|---|---|---|---|
| | | | CIELAB values | | | CIELAB values | | |
| | | $D_{min}$* | L* | a* | b* | L* | a* | b* |
| 1 | 0.09 | 0.11 | 87.42 | −0.87 | 5.05 | 86.34 | −1.27 | 7.68 |
| 2 | 0.09 | 0.10 | 87.54 | 0.53 | 1.59 | | | |
| 3 | 0.09 | 0.10 | 87.33 | 1.09 | 1.55 | | | |
| 4 | 0.09 | 0.12 | 78.97 | −2.69 | 12.4 | | | |
| 5 | 0.14 | 0.12 | 87.56 | −1.3 | 6.71 | | | |
| Invention example number | | | | | | | | |
| 1 | 0.08 | 0.10 | 87.90 | −0.14 | 3.15 | 87.41 | −0.56 | 4.57 |
| 2 | 0.08 | 0.10 | 87.88 | −0.24 | 3.37 | 87.49 | −0.06 | 4.06 |

*through a blue filter after 3d at 57° C. & 34% RH

The stability of the image background of the materials of comparative examples 1 to 5 and invention examples 1 and 2 to post-image development exposure was evaluated by first thermally treating the materials for 3 days at 57° C. and 34% relative humidity, next producing images in the materials by image-wise thermal development and finally exposing the images formed in the materials for 3 days on top of the white PVC window of a specially constructed light-box placed in a Votsch conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested.

The suitability of a material was assessed on the basis of the initial background density determined through a blue filter using a MacBeth™ TR924 densitometer, the background density through a blue filter after exposure on the lightbox for 3 days at 30° C. and 85% relative humidity and the L*, a* and b* CIELAB-values of the background after 3 days and 6 days exposure in the lightbox at 30° C. and 85% relative humidity. The L*, a* and b* CIELAB-values of the background were determined by spectrophotometric measurements according to ASTM Norm E179-90 in a R(45/0) geometry with evaluation according to ASTM Norm E308-90. The $D_{min}$-values before lightbox exposure and after 3 days lightbox exposure and the L*, a*, and b* CIELAB-values after 3 days and 6 days lightbox exposure for the Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive. Visually acceptable colour neutrality corresponds to an a*-value between -1.5 and +0.4 together with b*-value between −5.0 and +4.4.

The results in table 3 for the materials of comparative examples 1, 4 and 5 exhibit significantly higher $D_{min}$-values after 3 days lightbox exposure than those for invention examples 1 and 2 after 3 days lightbox. The materials of invention examples 1 and 2 also exhibit backgrounds with a higher degree of colour neutrality as adjudged by their a*- and b*-values after 3 days and 6 days lightbox exposure than those of comparative examples 1, 4 and 5, which fall outside the values required for visually acceptable colour neutrality given above. Thus the materials of comparative examples 1, 4 and 5 exhibit backgrounds with a too yellow tone, a too green and a much too yellow tone and a too yellow tone respectively.

Comparative examples 1 to 5 show by comparison with invention examples 1 and 2 that substantially non-photosensitive recording materials comprising a thermosensitive element comprising a substituted or unsubstituted 1,2,4-triazole compound with at least one of the nitrogen atoms having a hydrogen atom and none of the carbon atoms being part of a thione-group, the compound not being annulated with an aromatic ring system, exhibit images with superior stability and images and background with superior colour neutrality compared with materials without such compounds (comparative example 1), materials with tribromomethyl benzenesulfinate, C01, a classical stabilizer for photothermographic materials (as disclosed in U.S. Pat. No. 3,874,946) C01 (comparative examples 2 and 3) and materials with the classical silver halide photographic emulsion stabilizer C02, an unsaturated annulated 5-membered heterocyclic ring consisting of nitrogen and carbon atoms without a nitrogen atom with a hydrogen atom (comparative examples 4 and 5).

INVENTION EXAMPLE 3 and COMPARATIVE EXAMPLES 6 to 10

The substantially non-photosensitive recording materials of invention example 3 and comparative examples 6 to 10 were produced as described for invention examples 1 and 2 and comparative examples 2 to 5 except that compounds C03, C04, S02 were used instead of compounds C01, C02 and S01. The substantially non-photosensitive recording material of comparative example 6 was produced as described for comparative example 1. The compositions of the resulting layers are given in table 4.

TABLE 4

| Comparative example number | Additional ingredient number | Additional ingredient quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
|---|---|---|---|---|---|---|---|---|---|---|
| 6 | — | — | 4.95 | 19.81 | 1.015 | 0.271 | 0.140 | 0.044 | 0.158 | 0.422 |
| 7 | C03 | 0.083 | 4.98 | 19.89 | 1.019 | 0.272 | 0.139 | 0.044 | 0.159 | 0.424 |
| 8 | C03 | 0.272 | 4.93 | 19.69 | 1.008 | 0.269 | 0.138 | 0.044 | 0.158 | 0.420 |
| 9 | C04 | 0.041 | 4.95 | 19.80 | 1.014 | 0.271 | 0.138 | 0.044 | 0.158 | 0.422 |
| 10 | C04 | 0.129 | 4.95 | 19.83 | 1.015 | 0.271 | 0.139 | 0.044 | 0.159 | 0.423 |
| Invention example number | | | | | | | | | | |
| 3 | S02 | 0.206 | 4.98 | 19.91 | 1.020 | 0.272 | 0.140 | 0.044 | 0.160 | 0.425 |

Thermographic printing and image evaluation were carried out on the resulting materials as described for invention examples 1 and 2 and comparative examples 1 to 5. The $D_{max}$-, $D_{min}$- and NCV-values obtained with the materials of invention example 3 and comparative examples 6 to 10 are summarized in table 5.

TABLE 5

| Comparative example number | image characteristics printing with fresh material: $D_{max}$ vis | NCV at D = 1 | NCV at D = 2 | NCV at D = 3 | $D_{min}$ vis | image characteristics printing after 3 days at 57° C. & 34% RH: $D_{max}$ vis | NCV at D = 1 | NCV at D = 2 | NCV at D = 3 | $D_{min}$ vis |
|---|---|---|---|---|---|---|---|---|---|---|
| 6 | 3.07 | 0.92 | 0.98 | 0.97 | 0.07 | 3.79 | 0.77 | 0.77 | 0.84 | 0.07 |
| 7 | 3.14 | 0.79 | 0.72 | 0.65 | 0.07 | 3.60 | 0.68 | 0.67 | 0.62 | 0.07 |
| 8 | 2.74 | 0.63 | 0.50 | | 0.07 | 3.29 | 0.60 | 0.56 | 0.57 | 0.07 |
| 9 | 2.86 | 0.92 | 0.98 | | 0.07 | 3.72 | 0.78 | 0.82 | 0.88 | 0.07 |
| 10 | 2.56 | 0.91 | 0.93 | | 0.07 | 3.46 | 0.85 | 0.86 | 0.87 | 0.07 |
| Invention example number | | | | | | | | | | |
| 3 | 2.46 | 0.95 | 1.00 | | 0.07 | 3.47 | 0.87 | 0.91 | 0.94 | 0.07 |

It is evident from table 5 that with the exception of the mateial of comparative examples 7 and 8 with the stabilizing compound C03, all fresh materials of comparative examples 6 to 10 and invention example 3 formed images with excellent colour neutralities i.e. NCV-values above 0.90 and that there was also that the NCV-values for the materials of comparative examples 6 and 8 to 10 after thermal treatment for 3 days at 57° C. and 34% relative humidity were only marginally inferior to that of invention example 3.

The results concerning the stability of the image background obtained as described for invention examples 1 and 2 and comparative examples 1 to 5 are summarized in table 6.

TABLE 6

| Comparative example number | $D_{min}$* pre-exposure | Colour neutrality of background: After 3 days exposure on lightbox at 30° C. & 85% RH | | | | After 6 days exposure on lightbox at 30° C. & 85% RH | | |
|---|---|---|---|---|---|---|---|---|
| | | | CIELAB values | | | CIELAB values | | |
| | | $D_{min}$* | L* | a* | b* | L* | a* | b* |
| 6 | 0.08 | 0.12 | 86.83 | −2.18 | 9.87 | 86.54 | −2.36 | 11.64 |
| 7 | 0.09 | 0.11 | 86.60 | −0.11 | 6.28 | 86.46 | −0.23 | 7.31 |
| 8 | 0.10 | 0.11 | 86.34 | 1.43 | 4.76 | | | |
| 9 | 0.09 | 0.21 | 84.84 | −4.18 | 24.97 | | | |
| 10 | 0.09 | 0.28 | 84.05 | −6.33 | 34.71 | | | |
| Invention example number | | | | | | | | |
| 3 | 0.09 | 0.10 | 87.41 | −0.11 | 3.79 | 87.15 | −0.39 | 5.19 |

*through a blue filter after 3d at 57° C. & 34% RH

Table 6 shows that the materials of comparative examples 6, 9 and 10 exhibit significantly higher $D_{min}$-values after 3 days lightbox exposure than that for invention example 3 after 3 days lightbox. The material of invention example 3 also exhibits a background with a higher degree of colour neutrality as adjudged by their a*- and b* values after 3 days and 6 days lightbox exposure than those of comparative examples 6, 9 and 10, which fall outside the values required for visually acceptable colour neutrality given above. Thus the materials of comparative examples 6, 9 and 10 all exhibit backgrounds with a too yellow tone, comparative examples 6, 9 and 10 also exhibit a too green tone and comparative example 8 exhibits a too red tone.

Comparative examples 6 to 10 show by comparison with invention examples 1 to 3 that substantially non-photosensitive recording materials comprising a thermosensitive element comprising a substituted or unsubstituted 1,2,4-triazole compound with at least one of the nitrogen atoms having a hydrogen atom and none of the carbon atoms being part of a thione-group, the compound not being annulated with an aromatic ring system, exhibit images with superior stability and images and background with superior colour neutrality compared with materials without such compounds (comparative example 6), materials with C03, an unsaturated 5-membered heterocyclic ring consisting of nitrogen and carbon atoms without a nitrogen with a hydrogen atom substituted with a -SH group (comparative examples 7 and 8) and materials with C04, an unsaturated 5-membered heterocyclic ring with an oxygen ring atom substituted with a —SH group (comparative examples 9 and 10).

COMPARATIVE EXAMPLES 11 to 13

The substantially non-photosensitive recording materials of comparative examples 11 to 13 were produced as described for invention examples 1 and 2 and comparative examples 2 to 5 except that compound C05 was used instead of compounds C01, C02, S01, S02, S03 and S04. The substantially non-photosensitive recording material of comparative example 11 was produced as described for comparative example 1. The compositions of the resulting layers are given in table 7.

TABLE 7

| Comparative example number | Additional ingredient: number | quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
|---|---|---|---|---|---|---|---|---|---|---|
| 11 | — | — | 5.22 | 20.86 | 1.069 | 0.285 | 0.147 | 0.046 | 0.167 | 0.444 |
| 12 | C05 | 0.190 | 5.40 | 21.61 | 1.106 | 0.295 | 0.151 | 0.048 | 0.173 | 0.461 |
| 13 | C05 | 0.612 | 5.19 | 20.77 | 1.063 | 0.283 | 0.146 | 0.046 | 0.166 | 0.444 |

Thermographic printing and image evaluation were carried out on the resulting materials as described for invention examples 1 and 2 and comparative examples 1 to 5. The $D_{max}$-, $D_{min}$- and NCV-values obtained with the materials of comparative examples 11 to 13 are summarized in table 8.

TABLE 8

| Comparative example number | image characteristics printing with fresh material | | | | | image characteristics printing after 3 days at 57° C. & 34% RH | | | | |
|---|---|---|---|---|---|---|---|---|---|---|
| | $D_{max}$ vis | NCV at D = 1 | NCV at D = 2 | NCV at D = 3 | $D_{min}$ vis | $D_{max}$ vis | NCV at D = 1 | NCV at D = 2 | NCV at D = 3 | $D_{min}$ vis |
| 11 | 2.84 | 0.88 | 0.95 | | 0.07 | 3.66 | 0.75 | 0.76 | 0.80 | 0.07 |
| 12 | 2.82 | 0.90 | 0.92 | | 0.07 | 3.11 | 0.68 | 0.64 | 0.58 | 0.07 |
| 13 | 2.45 | 0.80 | 0.78 | | 0.07 | 2.50 | 0.54 | 0.47 | | 0.07 |

It is evident from table 8 that the material of comparative example 12 exhibits excellent image colour neutrality when fresh i.e. NCV-values above 0.90, but that of comparative example 13 with a higher concentration of C05 does not. After thermal treatment for 3 days at 570° C. and 34% relative humidity, there was a marked deterioration in the image colour neutrality for both materials.

The results concerning the stability of the image background obtained as described for invention examples 1 and 2 and comparative examples 1 to 5 are summarized in table 9.

TABLE 9

| Comparative example number | $D_{min}$* pre-exposure | Colour neutrality of background: After 3 days exposure on lightbox at 30° C. & 85% RH | | | | After 6 days exposure on lightbox at 30° C. & 85% RH | | |
|---|---|---|---|---|---|---|---|---|
| | | $D_{min}$* | CIELAB values L* | a* | b* | CIELAB values L* | a* | b* |
| 11 | 0.09 | 0.11 | 87.24 | −0.62 | 5.26 | 86.35 | −1.25 | 7.93 |
| 12 | 0.11 | 0.10 | 87.81 | −1.21 | 5.06 | | | |
| 13 | 0.12 | 0.13 | 86.49 | −2.83 | 12.55 | | | |

*through a blue filter after 3d at 57° C. & 34% RH

Table 9 shows that the materials of comparative examples 11 and 13 exhibit significantly increased $D_{min}$-values after 3 days lightbox exposure. The materials of comparative examples 11 and 13 both exhibit backgrounds with a too yellow tone and that of comparative example 13 also with a too green tone.

Comparative examples 11 to 13 show by comparison with invention examples 1 to 3 that substantially non-photosensitive recording materials comprising a thermosensitive element comprising a substituted or unsubstituted 1,2,4-triazole compound with at least one of the nitrogen atoms having a hydrogen atom and none of the carbon atoms being part of a thione-group, the compound not being annulated with an aromatic ring system, exhibit images with superior stability and images and background with superior colour neutrality compared with materials without such compounds (comparative example 11) and materials with C05, an unsaturated 5-membered heterocyclic ring consisting of nitrogen and carbon atoms without a nitrogen atom with a hydrogen atom (comparative examples 12 and 13).

COMPARATIVE EXAMPLES 14 and 15

The substantially non-photosensitive recording materials of comparative examples 14 and 15 were produced as described for invention examples 1 and 2 and comparative examples 2 to 5 except that compound C06 was used instead of compounds C01, C02 and S01. The compositions of the resulting layers for comparative examples 14 and 15 are given in table 10 with the composition of the layer of the material of comparative example 6 being included for the sake of comparison.

TABLE 10

| Comparative example number | Additional ingredient: number | quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
|---|---|---|---|---|---|---|---|---|---|---|
| 6 | — | — | 4.95 | 19.81 | 1.015 | 0.271 | 0.140 | 0.044 | 0.158 | 0.422 |
| 14 | C06 | 0.044 | 4.95 | 19.80 | 1.014 | 0.271 | 0.138 | 0.044 | 0.158 | 0.421 |
| 15 | C06 | 0.145 | 4.87 | 19.50 | 0.998 | 0.267 | 0.137 | 0.043 | 0.156 | 0.415 |

Thermographic printing and image evaluation were carried out on the resulting materials as described for invention examples 1 and 2 and comparative examples 1 to 5. The $D_{max}$-, $D_{min}$- and NCV-values obtained with the materials of comparative examples 14 and 15 are summarized in table 11 together with that for comparative example 6.

TABLE 11

| Comparative example number | image characteristics printing with fresh material | | | | | image characteristics printing after 3 days at 57° C. & 34% RH | | | | |
|---|---|---|---|---|---|---|---|---|---|---|
| | $D_{max}$ vis | NCV at D = 1 | NCV at D = 2 | NCV at D = 3 | $D_{min}$ vis | $D_{max}$ vis | NCV at D = 1 | NCV at D = 2 | NCV at D = 3 | $D_{min}$ vis |
| 6 | 3.07 | 0.92 | 0.98 | 0.97 | 0.07 | 3.79 | 0.77 | 0.77 | 0.84 | 0.07 |
| 14 | 3.26 | 0.82 | 0.78 | 0.70 | 0.07 | 3.66 | 0.76 | 0.80 | 0.78 | 0.07 |
| 15 | 2.51 | 0.66 | 0.53 | | 0.07 | 2.87 | 0.68 | 0.65 | | 0.07 |

It is evident from table 11 that the materials both fresh and after after thermal treatment for 3 days at 57° C. and 34% relative humidity exhibited a poor colour neutrality i.e. NCV-values considerably below 0.90.

The results concerning the stability of the image background obtained as described for invention examples 1 and 2 and comparative examples 1 to 5 are summarized in table 12 for comparative examples 14 and 15 together with those for the materials of comparative example 6 for the sake of comparison.

TABLE 12

| Comparative example number | $D_{min}$* pre-exposure | Colour neutrality of background: After 3 days exposure on lightbox at 30° C. & 85% RH | CIELAB values | | | After 6 days exposure on lightbox at 30° C. & 85% RH | CIELAB values | |
|---|---|---|---|---|---|---|---|---|
| | | $D_{min}$* | L* | a* | b* | L* | a* | b* |
| 6. | 0.08 | 0.12 | 86.83 | −2.18 | 9.87 | 86.54 | −2.36 | 11.64 |
| 14 | 0.09 | 0.18 | 85.24 | −2.32 | 18.58 | | | |
| 15 | 0.10 | 0.28 | 82.42 | −2.64 | 33.17 | | | |

*through a blue filter after 3d at 57° C. & 34% RH

Table 12 shows that all the materials after 3 days exposure in the lightbox at 30° C. and 85% relative humidity exhibited poor colour neutrality with a very strong yellow tone as indicated by high positive b*-values and a fairly strong green tone as indicated by the moderately high negative a*-values.

Comparative examples 6, 14 and 15 show by comparison with invention examples 1 to 3 that substantially non-photosensitive recording materials comprising a thermosensitive element comprising a substituted or unsubstituted 1,2,4-triazole compound with at least one of the nitrogen atoms having a hydrogen atom and none of the carbon atoms being part of a thione-group, the compound not being annulated with an aromatic ring system, exhibit images with superior stability and images and background with superior colour neutrality compared with materials without such compounds (comparative example 6) and materials with C06, an unsaturated 5-membered heterocyclic ring with a sulphur ring atom substituted with a —SH group (comparative examples 14 and 15).

Having described in detail preferred embodiments of the current invention, it will now be apparent to those skilled in the art that numerous modifications can be made therein without departing from the scope of the invention as defined in the following claims.

We claim:

1. A substantially non-photosensitive recording material comprising a thermosensitive element comprising a substantially light-insensitive organic silver salt, an organic reducing agent therefor in thermal working relationship therewith, a 1,2,4-triazole compound with at least one of the nitrogen atoms having a hydrogen atom and none of the carbon atoms being part of a thione-group, said compound not being annulated with an aromatic ring system, in reactive association with said substantially light-insensitive organic silver salt and said organic reducing agent and a binder, on a support.

2. Recording material according to claim 1, wherein said 1,2,4-triazole compound is substituted at a carbon atom with an alkyl, substituted alkyl, alkaryl, substituted alkaryl, aryl or substituted aryl thioether group.

3. Recording material according to claim 1, wherein said substantially light-insensitive organic silver salt is a substantially light-insensitive fatty acid silver salt.

4. Recording material according claim 1, wherein said thermosensitive element is coated with a protective layer.

5. A thermal image recording process comprising the steps of: (i) providing a substantially non-photosensitive recording material comprising a substantially light-insensitive organic silver salt, an organic reducing agent therefor in thermal working relationship therewith, a 1,2,4-triazole compound with at least one of the nitrogen atoms having a hydrogen atom and none of the carbon atoms being part of a thione-group, said compound not being annulated with an aromatic ring system, in reactive association with said substantially light-insensitive organic silver salt and said organic reducing agent and a binder, on a support; (ii) bringing an outermost layer of said recording material into proximity with a heat source; (iii) applying heat from a heat source image-wise to said recording material while maintaining proximity to said heat source to produce an image; and (iv) removing said recording material from said heat source.

6. Thermal image forming process according to claim 5, wherein said heat source is a thermal head.

* * * * *

UNITED STATES PATENT AND TRADEMARK OFFICE

CERTIFICATE OF CORRECTION

PATENT NO. : 5,750,319

DATED : May 12, 1998

INVENTOR(S) : Horsten et al.

It is certified that error appears in the above-identified patent and that said Letters Patent is hereby corrected as shown below:

In Table 2, Column 12, for Invention example number 2, cancel "0.07" under the column heading at D = 3 (first occurrence); insert --0.07-- under the column heading $D_{min}$ vis (first occurrence).

Signed and Sealed this

Fourth Day of May, 1999

*Attest:*

*Attesting Officer*

Q. TODD DICKINSON

*Acting Commissioner of Patents and Trademarks*